US005226397A

United States Patent [19]

Zabeck et al.

[11] Patent Number: 5,226,397

[45] Date of Patent: Jul. 13, 1993

[54] APPARATUS FOR FEEDING VOLATILE FUEL COMPONENTS IN MEASURED QUANTITIES INTO THE INTAKE TUBE OF AN INTERNAL COMBUSTION ENGINE

[75] Inventors: Sebastian Zabeck, Hemsbach; Andreas Sausner, Frankfurt, both of Fed. Rep. of Germany

[73] Assignee: Firma Carl Freudenberg, Weinheim/Bergstr., Fed. Rep. of Germany

[21] Appl. No.: 861,902

[22] Filed: Apr. 1, 1992

[30] Foreign Application Priority Data

Apr. 8, 1991 [DE] Fed. Rep. of Germany ..... 4111259

[51] Int. Cl.[5] ..... F02M 33/02

[52] U.S. Cl. ..... 123/516; 123/518; 123/520

[58] Field of Search ..... 123/516, 518, 519, 520, 123/521

[56] References Cited

U.S. PATENT DOCUMENTS

| | | | |
|---|---|---|---|
| 3,491,736 | 1/1970 | Walker | 123/521 |
| 4,059,081 | 11/1977 | Kayanuma | 123/521 |
| 4,230,082 | 10/1980 | Jurschewitz | 123/518 |
| 4,283,356 | 8/1981 | Arai et al. | 123/519 |
| 4,703,738 | 11/1987 | Deminco et al. | 123/520 |
| 4,901,702 | 2/1990 | Beicht et al. | 123/520 |
| 4,995,369 | 2/1991 | Cook | 123/520 |
| 5,069,188 | 12/1991 | Cook | 123/520 |
| 5,083,546 | 1/1992 | Detweiler et al. | 123/520 |

*Primary Examiner*—E. Rollins Cross
*Assistant Examiner*—Thomas Moulis
*Attorney, Agent, or Firm*—Kenyon & Kenyon

[57] ABSTRACT

An apparatus for temporarily storing and feeding in measured quantities the volatile fuel components found in the free space of a tank installation into the intake tube of an internal combustion engine includes a vent line which connects the free space to the atmosphere. A storage chamber with an absorption element is arranged in the vent line. A line connects the storage chamber to the intake tube and is capable of being sealed by a valve. A throttle valve is supported on a drive shaft and is configured in the intake tube. The valve includes an actuator, which is capable of being operated by the drive shaft.

26 Claims, 3 Drawing Sheets

APPARATUS FOR FEEDING VOLATILE FUEL COMPONENTS IN MEASURED QUANTITIES INTO THE INTAKE TUBE OF AN INTERNAL COMBUSTION ENGINE

BACKGROUND OF THE INVENTION

The present invention relates generally to an apparatus for the temporary storage and measured feeding of volatile fuel components, and more particularly to an apparatus for the temporary storage and measured feeding of volatile fuel components found in the free space of a tank system into the intake tube of an internal combustion engine.

Such an apparatus includes a vent line connecting the free space to the atmosphere, in which is arranged a storage chamber having an absorption element. The apparatus also includes a line which connects the storage chamber to the intake tube and which is capable of being sealed by a valve. A throttle valve supported on a drive shaft is disposed in the intake tube.

Such an apparatus as described above is disclosed in German Patent 38 02 664. The valve and the throttle valve can thereby be actuated independently of one another, whereby the throttle valve is actuated mechanically and the valve is actuated with the aid of electronic and electromechanical means. These means are interconnected by signal lines and are connected to sensors, which continuously acquire various characteristic data relating to the internal combustion engine during its operation. Therefore, constructing and assembling such a device is costly.

The present invention is directed to an apparatus of the above-mentioned type that has a simplified construction that can be easily assembled, and further has excellent working properties with a long serviceable life.

SUMMARY OF THE INVENTION

The present invention provides an apparatus for the temporary storage and measured feeding of volatile fuel components found in the free space of a tank system into an intake tube of an internal combustion engine. The apparatus includes a vent line connecting the free space to the atmosphere and a storage chamber having an absorption element is disposed in the vent line. Additionally, a line connects the storage chamber to the intake tube and a valve is provided for sealing the line. The valve includes an actuator that is operational by the drive shaft. A throttle valve is supported on the drive shaft and disposed in the intake tube.

In the apparatus of the invention, the valve comprises an actuator, which can be operated by the drive shaft of the throttle valve. In this manner, the volatile fuel components can be properly fed into the intake tube of the internal combustion engine attached thereto while ensuring good operational performance and a good performance of the internal combustion engine. As a result, the device may also be used in the manufacturing of cost-effective motor vehicles. Furthermore, the resulting apparatus is highly dependable during operation because it is arranged between the absorption element and the intake tube in a purely mechanical manner and without the use of sensors.

According to another aspect of the invention, the valve is designed as a rotary-slide valve, with a valve housing and two adjusting disks. The adjusting disks are supported in the valve housing and contact one another such that they can rotate relative to one another. The adjusting disks are each provided outside of their respective torsional axes with at least one opening which is able to be covered. Moreover, the first adjusting disk is rotatable by means of the drive shaft, and the second adjusting disk is locked to prevent rotation in the valve housing. It is advantageous if in this embodiment of the invention the valve has a particularly small type of construction, consisting of few component parts, and that it is particularly simple to drive the rotary slide valve by means of the drive shaft, on which the throttle valve is also supported. Also, the size of the at least partially covered openings should be capable of very fine adjustments in response to the current operating state of the internal combustion engine As a result of the small design and the fact that few component parts are used, the resulting apparatus weighs less and entails lower manufacturing costs.

The first adjusting disk and the drive shaft may be interconnected by a connecting device, whereby the connecting device is designed as a one-sided restricted guidance restraint. In case of potential operating malfunctions inside the device, it is advantageous if the mobility of the throttle valve is retained in the intake tube, at least in the direction of the closed position. This can contribute, for example, to the functional reliability of a motor vehicle. The connecting device may be formed from two levers, for example, with the first lever frictionally connected to the drive shaft of the throttle valve and the second lever frictionally connected to one of the adjusting disks. A catch, for example, may be configured on the first lever. This catch only contacts the second lever in the open direction of the throttle valve. When actuated, the catch carries over the shutoff valve against the spring tension, from a torque spring, for example, to the open position. If the throttle valve is in the open position, it can be shifted to the closed position at any time, even when malfunctions occur inside the device.

The second adjusting disk can be movably supported only in the direction of the torsional axis and can be secured with respect to the valve housing by a membrane to prevent rotation and to provide a seal. The rotatably supported arrangement of the first adjusting disk relative to the second adjusting disk, which is rotatably fixed in the housing, guarantees, even over a long operating life, that the two adjusting disks will be properly sealed off from one another. Even less wear (i.e. abrasion) on one of the two adjusting disks will not adversely affect the seal in this vicinity, because the second adjusting disk is braced by means of a compression spring in the valve housing so that it is pressed against the first adjusting disk. To effectively seal off the valve from the environment, a membrane is provided. The membrane may be inserted, for example, between the two valve-housing parts and can be molded onto the second adjusting disk. If the openings of the two adjusting disks are closed, no volatile fuel components arrive in the intake tube of the internal combustion engine. If the compression spring is designed like a helical compression spring, its spring characteristic can be adjusted quite easily to the material-specific characteristic values of the two adjusting disks. This produces excellent working properties for the valve over a long operating life.

According to yet another aspect of the invention, the two adjusting disks may be rotatably supported one inside the other. This can be achieved, for example, by using a bearing journal that is connected in one piece to the first adjusting disk. If necessary, for example to offset manufacturing tolerances, this bearing journal can have a convex (i.e. crown-type) design. The bearing journal can be supported in a bearing-journal receptacle in the second adjusting disk. The bearing journal may also be connected in one piece to the second adjusting disk and supported in a bearing-journal receptacle of the first adjusting disk. Furthermore, both the first as well as the second adjusting disks may be provided with a journal-bearing receptacle, whereby a separate journal bearing, which interconnects the two adjusting disks, is arranged in the axial direction, coaxial to the torsional axis. These features of the invention ensure that the two adjusting disks have good torsional mobility relative to one another. These features also ensure that the two adjusting disks are properly positioned with respect to one another, outside of the openings and in a manner that is impermeable to gas.

The membrane can be attached in the axial direction, nearest the drive shaft, to the second adjusting disk so as to prevent turning. The membrane may have at least one recess with sealing edges, which have a size and shape that conform for the most part to the size and shape of the openings. In this case it is advantageous that the apparatus be capable of being produced more easily and cost-effectively.

Moreover, it may be advantageous for the membrane to form the second adjusting disk. In this case, the compression spring is braced on one side directly against the membrane and, on the other side, against the valve housing. This embodiment of the invention eliminates an additional component part affixed to the membrane.

To enable the apparatus to be actuated more easily and sensitively, at least one of the adjusting disks in the vicinity of the reciprocal contact surfaces can be provided with a friction-reducing surface coating. A PTFE film, which can be filled with another material, is particularly suited for use as a surface coating. A lubricating varnish, for example, may also be used.

To further improve the seal between the two adjusting disks outside of the openings, an intermediate disk of elastomer material can be arranged in the direction of the torsional axis between the two adjusting disks. The intermediate disk can be secured to one of the two adjusting disks so that it is relatively locked to prevent turning and to provide a seal. In addition to compensating for tolerance in the axial direction, which is caused by the compression spring, the intermediate disk formed from elastomer material enables tolerances to be offset in the circumferential direction of the two adjusting disks. For example, if the adjusting disks are not designed to be absolutely plane-parallel to one another, this does not affect the valve's functioning because it is compensated for by the intermediate disk. A proper functioning of the device is guaranteed in such a case.

According to another advantageous aspect of the invention, the valve may be designed like a sliding valve, with a valve housing and an adjusting piston. The adjusting piston is supported so that it can move axially in the valve housing and it contacts the coaxially arranged, axially movable sealing member by means of a connecting element. A non-rotatable sealing seat, which is arranged so that it is relatively immovable in the valve housing, is assigned to the sealing member. The adjusting piston and the sealing member are capable of being mutually actuated by a non-rotatable cam which is supported on the drive shaft. In this case, it is advantageous that particularly small dimensions are obtained in the direction of the drive shaft because the apparatus is tied radially to the drive shaft. The sealing member is provided with a sealing cone, which is self-centered on the sealing seat. Due to the possibly of self-locking occurring, the sealing seat is advantageously formed from an elastomer material. Depending upon the position of the throttle valve and thus of the drive shaft on which the cam is affixed to actuate the adjusting piston, the gas flow rate through the valve is regulated in the direction of the intake tube of the internal combustion engine.

The valve housing can be formed from a first and a second valve-housing part, whereby the first valve-housing part is supported coaxially in the second valve-housing part. The first valve-housing part can be sealed off from the second valve-housing part by O-ring seals. This feature of the invention makes it possible for the valve to be manufactured and assembled quite simply. Thus, it can be very well adapted to the current conditions to which it is applied.

The first and the second valve-housing part may be formed from a single piece. This configuration advantageously simplifies assembly and improves the operational reliability of the apparatus. The two valve-housing parts may, for example, be formed from a plastic having good sliding characteristics. In this manner, good working properties are guaranteed over a long service life.

The two valve-housing parts have an essentially tubular design, and at least the valve-housing part accommodating the adjusting piston may have, in the vicinity of the reciprocal contact surfaces, a low-friction and wear-resistant material. Also, a surface coating, which can be arranged in the radial direction between the first valve-housing part and the adjusting piston, provides a particularly low-friction displacement of the adjusting piston in its guidance element. Over and above that, the sensitive and precise manipulation of the valve is advantageously provided. The valve produces a precisely defined flow rate of the volatile fuel components into the intake tube of the internal combustion engine.

The component parts which contact one another and are movable relative to one another can be formed from plastic such as polyamide or polyimide, for example. Depending on the surface pressure and/or the thermal stress, the adjusting piston, for example, may also be formed from this material. The use of plastic is also advantageous because it produces an apparatus of lower weight. Furthermore, a bushing or a film of friction-reducing material can be arranged between the adjusting piston and the first valve-housing part.

A compression spring, which is braced in the housing and which presses the sealing member against the adjusting piston, assures that the sealing member is restored without delay. The spring determines the magnitude of the restoring force, with which the at least partially conical sealing member is pressed onto its sealing seat, which is advantageously formed from an elastomer material. The configuration of the sealing cone, as well as the one-sided restricted guidance of the connecting device, enable the shutoff valve to be shifted to the closed position without any actuating force. Another configuration of the sealing cone allows the shutoff valve, when practical, to be shifted into the open position without any actuating force.

According to yet another aspect of the invention, the valve may be designed like a slide valve, with a valve housing and a cylindrical adjusting piston. The cylindrical adjusting piston is supported in the valve housing so that it is movable only in the direction of the torsional axis and contacts the sealing member through a connecting element. A non-rotatable sealing seat, arranged to be relatively immovable in the valve housing, is allocated to the sealing member. The adjusting piston may have an external (i.e. male) thread along its outer surface. This external thread functions on one side and mates with a one-sided functioning internal (i.e. female) screw thread of an actuating part. Furthermore, the actuating part is arranged so that it can turn in the valve housing and is locked to prevent turning on the drive shaft. According to this embodiment of the invention, an axial control of the valve results in a translatory movement of the sealing member. The actuating part can be directly connected to the drive shaft on which the throttle valve is also configured. The sealing member has an at least partially conical design and is able to be lifted up from its sealing seat (which advantageously consists of an elastically deformable material) when the valve is opened. The elastically deformable material prevents a self-locking of the sealing member in the sealing seat and favors a self-centering action. As a result of the engaged and one-sided functioning threads of the adjusting piston and the actuating part, a rotation of the drive shaft causes the actuating part to turn. Consequently, the adjusting piston is only capable of moving translationally in the direction of the torsional axis depending upon the direction of rotation of the drive shaft. As a result of the one-sided functioning threads, which resemble a sloping plane, the rotation of the throttle-valve shaft causes the cross-sectional area through the valve to open up, while the valve can only be shifted, as needed, into the closed position by the spring tension of a compression spring. In this manner, the functional reliability of the internal combustion engine to which the valve is connected is maintained even when the apparatus is malfunctioning. The axial movement of the adjusting piston produces a change in the cross-sectional area between the sealing member and the adjoining valve seat and thus a change in the flow rate of the volatile fuel components through the valve into the intake tube of the internal combustion engine.

To enable the apparatus to be actuated with low friction, the adjusting piston and the actuating part may have a friction-reducing surface, at least in the area of their mutual contacting surfaces. A further reduction in the actuating force of the valve results when the contacting surfaces between the actuating part and the valve housing are also provided with a friction-reducing surface coating. This further facilitates the precise actuation of the valve. Moreover, the mutually contacting component parts can be fabricated from wear-resistant and low-friction plastic.

The surface coating may be formed from PTFE, for example. This coating has an exceptionally low rate of wear and is very wear-resistant due to a surface glazing which increases in the course of the actuation. Friction-reducing PTFE component parts can be embedded in plastic, for example.

A compression spring is provided to reset (i.e. pull back) the adjusting piston and thus place the sealing member on its sealing seat. The compression spring reinforces the closing travel of the throttle valve in the intake tube of the internal combustion engine and it presses the sealing member against the adjusting piston in a manner that is free from play.

An electromagnetic control valve, which seals off the supply line as necessary and which is connected via signal lines to a motor control unit, can be assigned to the valve. This configuration advantageously improves the functioning of the apparatus and the motor control unit can influence the functioning of the apparatus. The electromagnetic control valve can be actuated in a fixed cycle such as with a clock pulse or it can be integrated in the valve housing to better utilize the reconfigured space.

According to another embodiment of the invention, a throttle-valve switch may be allocated to and integrated in the valve housing. Furthermore, a potentiometer can be used in place of a throttle-valve switch. This enables the entire apparatus to have exceptionally compact dimensions.

DETAILED DESCRIPTION

Figure 1:
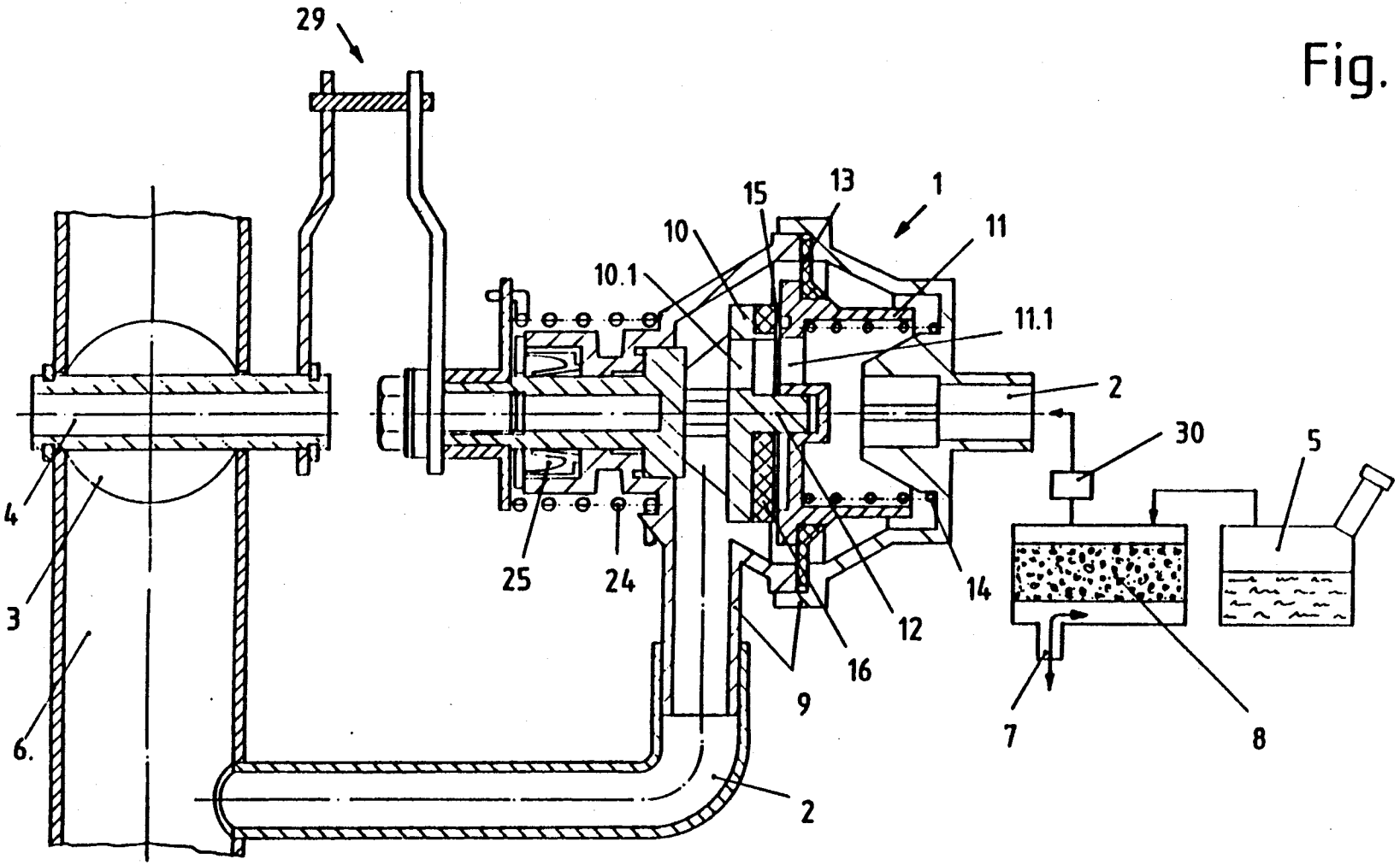
FIG. 1 shows a schematic view of the apparatus constructed according to the principles of the invention in which the valve is designed like a rotary-slide valve.

FIG. 1 shows an apparatus for temporarily storing and feeding in measured quantities the volatile fuel components found in the free space 5 of a tank system into the intake tube 6 of an internal combustion engine. A vent line 7, which connects the free space 5 to the atmosphere, has a storage chamber 8 with an absorption element of activated carbon arranged therein. A line 2 which connects the storage chamber 8 to the intake tube 6 is capable of being sealed by a valve 1. A throttle valve 3 supported on a drive shaft 4 is positioned in the intake tube 6. The valve 1 includes a rotary-slide valve as an actuator, which can be actuated by the drive shaft 4 and a connecting device 29. The rotary-slide valve essentially consists of two adjusting disks 10 and 11, which are arranged and supported in the valve housing 9 and contact on one another such that they may rotate relative to one another. Configured in each of the adjusting disks 10 and 11 are openings 10.1 and 11.1, which can have different sizes depending upon the specific application in each case. This illustrated embodiment provides for the first adjusting disk 10 to be supported in the valve housing 9 so that it can rotate by means of the drive shaft 4 relative to the second adjusting disk 11. The first adjusting disk 10 is provided with a compensation disk 16 that is molded directly onto the first adjusting disk 10. Alternatively, the compensation disk 16 can be slipped onto or attached onto the first adjusting disk 10. To improve the sliding characteristics, the compensation disk 16 is provided with a surface coating 15, which is formed from a PTFE film. The two adjusting disks 10 and 11 lie outside of the at least partially covered openings 10.1 and 11.1, so that they are capable of rotating and are impermeable to gas. To seal off the valve housing 9 from the atmosphere and to seal off the intake space and the outlet space, a membrane 13 formed from an elastomer material, for example, is clamped between the two housing halves and affixed to the second adjusting disk 11. In addition, the membrane 13 constitutes an anti-rotation element for the second adjusting disk 11. This configuration provides excellent sealing between the gas intake and gas outlet when the openings 10.1 and 11.1 are closed. To improve the sealing effect and to apply an initial stress, the second adjusting disk 11 is movably braced in the direction of the torsional axis 12 by means of a compression spring 14 disposed in the valve housing 9 so that the second adjusting disk 11 is pressed against the first adjusting disk 10. The two adjusting disks 10 and 11 are localized so that one can rotate inside the other by means of a bearing journal of the first adjusting disk 10 which is arranged coaxially to the torsional axis 12 and supported in a recess of the second adjusting disk 11. The bearing journal can have both a cylindrical as well as a crown-type design. In addition to the compression spring 14, another spring is provided, which is designed as a torque spring 24. Furthermore, a seal 25, which seals off the drive opening from the environment, is provided between the drive shaft 4 and the valve housing 9.

The electromagnetically operable control valve 30, which can be allocated to the valve 1 and which seals off the line 2, as needed, can be coupled via a signal line to a motor control unit, which is not shown. It is thereby possible for the electromagnetically operable control valve 30 to be configured inside the line 2 or integrated in the valve housing. By integrating the control valve 30 in the valve housing, one obtains a device that can be installed quite easily.

Figure 2:
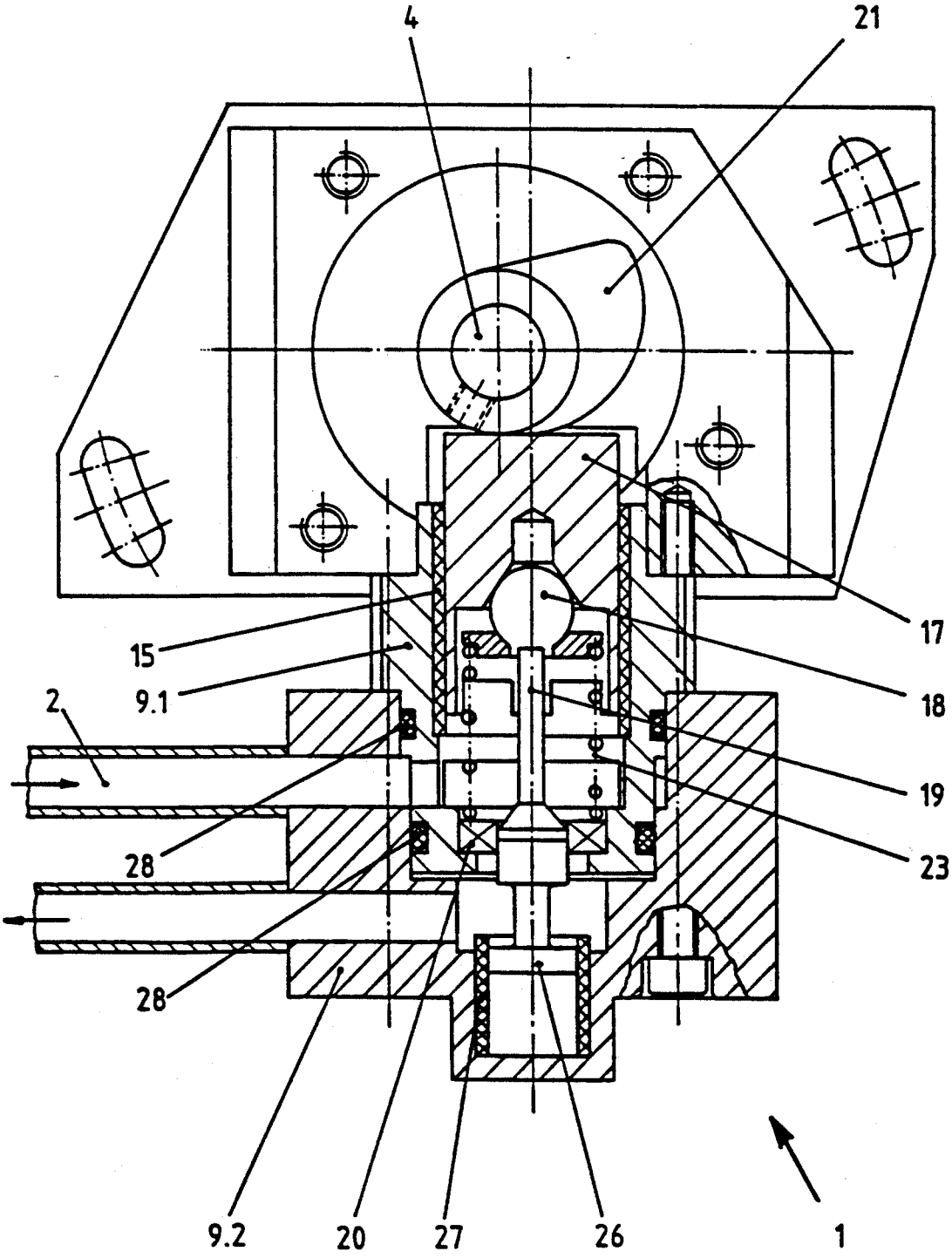
FIG. 2 shows a cross-sectional view of the apparatus seen in FIG. 1, but with a sealing member that can be translationally moved and controlled in the radial direction.

FIG. 2 shows a valve 1 that can be controlled by a cam 21 in the radial direction to the drive shaft 4. The following description provides further details concerning the operation of the valve 1.

The cam 21 is torsionally fixed on the drive shaft 4, which is formed by the throttle-valve shaft. Depending on the position of the throttle valve, the cam 21 presses on the surface of the adjusting piston 17, which is supported in the first valve-housing part 9.1. A surface coating 15 in the form of a friction-reducing bushing is provided to reduce the friction between the relatively movable parts. The sealing member 19 has an at least partially conical design and, when the valve is in the closed position, sealingly abuts in this area against its sealing seat 20. To compensate for axial play and to prevent self-locking, the sealing seat 20 and/or the sealing cone consist of an elastically deformable material such as an elastomer. In the axial direction opposite the adjusting piston 17, the sealing member 19 is provided with a guidance element 26 situated in a guide bush 27. To seal off the two housing parts 9.1 and 9.2, O-ring seals 28 are arranged between the coaxially configured valve-housing parts 9.1 and 9.2, which are supported one within the other in the radial direction. The closing movement of the valve is caused by a compression spring 23, which is arranged between the housing part 9.1 and the sealing member 19 and which presses the sealing member against the adjusting piston 17 in a manner that is free from play.

Figure 3B:
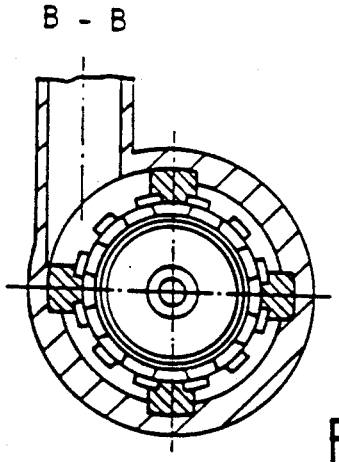
FIG. 3*b* is a cross-sectional view of FIG. 3*a* taken along line B—B.
Figure 3A:
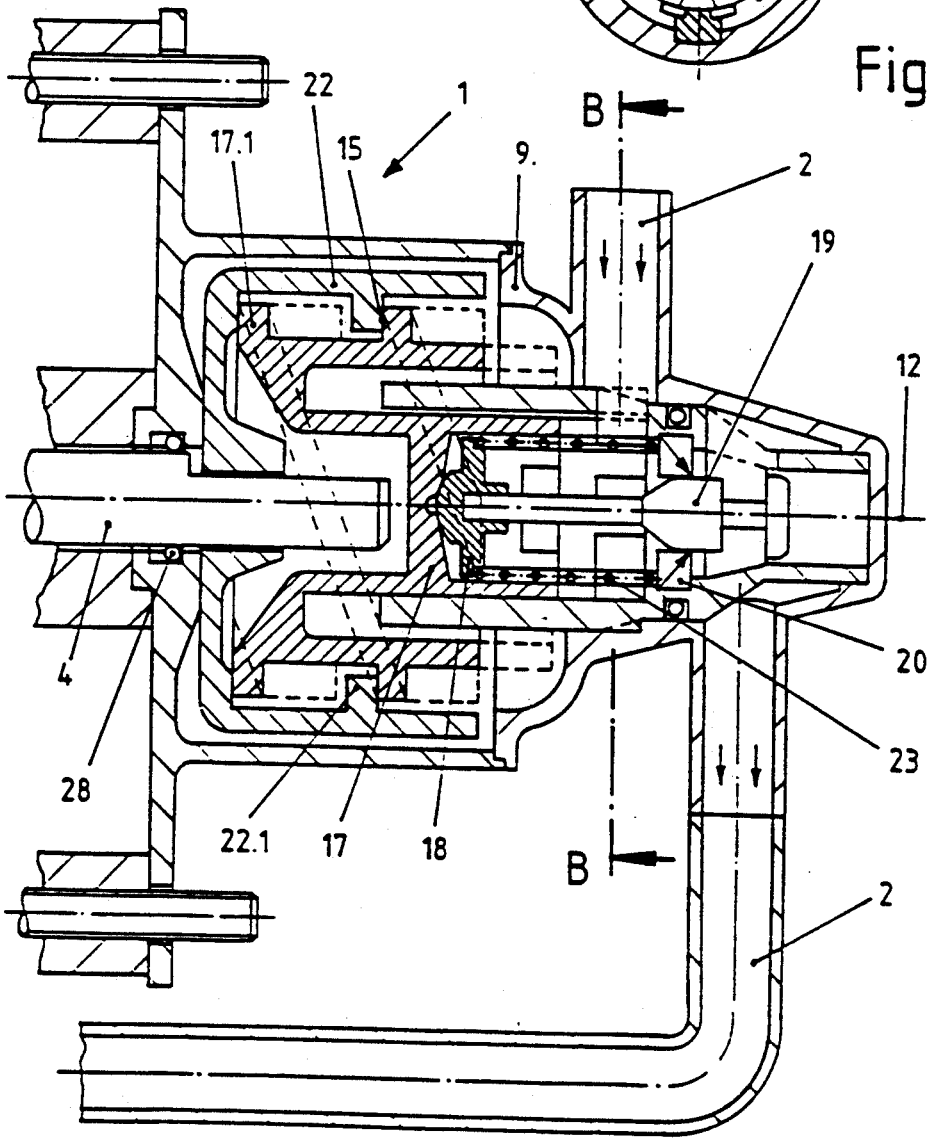
FIG. 3*a* shows an alternative embodiment of the invention in which the valve has a sealing member capable of translatory movement and featuring axial control.

A valve 1, which forms part of the apparatus of the invention, is shown as a separate component in FIG. 3*a*. The sealing member 19 can be moved translationally in the same manner as in FIG. 2. However, the actuating part 22 is controlled in the axial direction by the drive shaft 4, on which the throttle valve (not depicted here) is also mounted. The functioning of the valve 1 shown in FIG. 3*a* corresponds essentially to that of the valve described in FIG. 2. However, the actuating part 22 is provided with an internal screw thread 22.1, which functions on only one side and mates with the external thread 17.1 of the adjusting piston 17, which likewise only functions on one side. In the open position, the valve is carried over by the rotation of the drive shaft 4, while the compression spring 23 seals off the passage through the valve 1, as needed. Even if the apparatus malfunctions, this refinement produces good operational reliability for the internal combustion engine to which it is connected. To seal off the valve housing 9 from the drive shaft 4, a seal 28 is provided, which sealingly abuts the circular periphery of the drive shaft 4. To propel the actuating part 22, the drive shaft 4 is flattened on one side and guided through exactly the same recess of the actuating part 22. In FIG. 3*a*, the throttle valve (not shown) is in the closed position, in the same manner as is the valve i. The sealing member 19, whose sealing surface has a conical design, sealingly abuts against the sealing seat 20, which consists of elastomer material, as also described in FIG. 2. As the throttle valve is opened more and more by actuating the throttle-valve shaft 4, the actuating part 22 undergoes a rotary motion. Through this means, the adjusting piston 17 is moved in the direction of the torsional axis 12 and, in this manner, clears a cross-sectional opening through the valve 1. The compression spring 23 is braced in the housing 9 and positions the sealing member 19 against the adjusting piston 17 in a manner that is free from play.

To prevent the sealing member 19 and/or the sealing seat 20 from being worn on one side, a slewing mechanism can be provided for the sealing member.

What is claimed is:

1. An apparatus for the temporary storage and measured feeding of volatile fuel components found in the free space of a tank system into an intake tube of an internal combustion engine, said apparatus comprising:
   a) a vent line connecting the free space to the atmosphere;
   b) a storage chamber having an absorption element disposed in said vent line;
   c) a purge line which connects the storage chamber to the intake tube;
   d) a valve for sealing said purge line, said valve including an actuator that is operational by a drive shaft; and
   e) a throttle valve supported on the drive shaft and disposed in said intake tube.

2. The apparatus of claim 1 wherein said valve forms a rotary-slide valve and further comprising a valve housing and two adjusting disks supported in said valve housing, said adjusting disks contacting one another and being relatively rotatable with respect to one another, each of said disks having a torsional axis and at least one opening located beyond said torsional axis that is coverable, a first of said two adjusting disks being rotatable by said drive shaft and a second of said two adjusting disks being locked to prevent rotation in said valve housing.

3. The apparatus of claim 2 further comprising a connecting device coupling said first adjusting disk and said drive shaft, said connecting device forming a one-sided restricted guidance restraint.

4. The apparatus of claim 3 wherein said second adjusting disk is movably supported only in the direction of said torsional axis and is secured with respect to said valve housing to prevent rotation, and further comprising a membrane to seal said second adjusting disk.

5. The apparatus of claim 4 further comprising a compression spring disposed in the valve housing bracing the second adjusting disk against the first adjusting disk.

6. The device of claim 5 wherein said two adjusting disks are rotatably supported one within the other.

7. The apparatus of claim 6 wherein said membrane is fixedly attached in the axial direction to said second adjusting disk such that rotation is prevented, said membrane having at least one recess with sealing edges that substantially conform in size and shape to the openings in said two adjusting disks.

8. The apparatus of claim 7 wherein said membrane forms said second adjusting disk.

9. The apparatus of claim 8 wherein at least one of said two adjusting disks has a mutually contacting surface provided with a friction-reducing surface coating.

10. The apparatus of claim 9 wherein said surface coating comprises a PTFE film.

11. The apparatus of claim 10 further comprising an intermediate disk formed of a elastomer material on which said surface coating is arranged.

12. The apparatus of claim 11 wherein said intermediate disk is disposed between the two adjusting disks in the direction of the torsional axis, said intermediate disk being secured to one of said two adjusting disks so that it is locked to prevent rotation.

13. The apparatus of claim 12 wherein said two adjusting disks are formed from plastic.

14. The apparatus of claim 1 wherein said valve forms a sliding valve and further comprising:

a) a valve housing and an adjusting piston which is supported for axial motion in said valve housing;

b) a coaxially arranged, axially movable sealing member contacting said adjusting piston via a connecting element;

c) a non-rotatable sealing seat, which is relatively immovable, disposed in said valve housing and assigned to the sealing member;

d) a cam mutually actuating said adjusting piston and said sealing member, said cam being supported so that it is prevented from rotating on said driving shaft.

15. The device of claim 14 wherein said valve housing comprises a first and a second valve-housing part, said first valve-housing part being coaxially supported in said second valve-housing part and further comprising at least one o-ring seal sealing said first valve-housing part from said second valve-housing part.

16. The apparatus of claim 15 wherein said first and second valve-housing parts have a unitary configuration.

17. The apparatus of claim 16 wherein said first and second valve-housing parts are substantially tubular in shape, one of said first and second valve-housing parts accommodating said adjusting piston and having a reciprocal contact surface formed from a low-friction, wear-resistant material.

18. The apparatus of claim 17 wherein at least one mutually contacting part is formed from plastic.

19. The apparatus of claim 1 wherein said valve forms a slide valve and further comprising:

a) a valve housing and a cylindrical adjusting piston supported in said valve housing that is movable only in the direction of a torsional axis;

b) a connecting element and a sealing member, said connecting element coupling said adjusting piston to the sealing member;

c) a non-rotatable sealing seat substantially fixed in said valve housing and being allocated to the sealing member, said adjusting piston having an external thread along its outer surface, said external thread being functional on one side; and d) an actuating part having a one-sided functioning internal screw thread mating with said external thread, said actuating part being rotatable in said valve housing and being locked to prevent turning on the drive shaft.

20. The apparatus of claim 19 wherein said sealing seat is formed from an elastically deformable material.

21. The apparatus of claim 20 wherein said sealing member has an at least partially conical shape.

22. The apparatus of claim 21 wherein said adjusting piston and said actuating part each have a friction-reducing surface coating at least in the vicinity of their mutually contacting surfaces.

23. The apparatus of claim 22 further comprising a compression spring disposed in said valve housing bracing said sealing member and pressing said sealing member against said adjusting piston.

24. The apparatus of claim 23 further comprising an electromagnetic control valve allocated to said valve for sealing off said supply line, said electromagnetic control valve being operatively connected to a motor control unit.

25. The apparatus of claim 24 wherein said control valve is integrated in said valve housing.

26. The apparatus of claim 25 further comprising a throttle valve switch allocated to and integrated in said valve housing.

* * * * *